US009938954B2

(12) United States Patent
Nakamura

(10) Patent No.: US 9,938,954 B2
(45) Date of Patent: Apr. 10, 2018

(54) IGNITION CONTROL SYSTEM FOR INTERNAL COMBUSTION ENGINE

(71) Applicant: TOYOTA JIDOSHA KABUSHIKI KAISHA, Toyota-shi, Aichi-ken (JP)

(72) Inventor: Satoshi Nakamura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 107 days.

(21) Appl. No.: 15/097,690

(22) Filed: Apr. 13, 2016

(65) Prior Publication Data

US 2016/0305391 A1 Oct. 20, 2016

(30) Foreign Application Priority Data

Apr. 15, 2015 (JP) ..... 2015-083556

(51) Int. Cl.
*F02P 5/145* (2006.01)
*F02P 15/00* (2006.01)
(Continued)

(52) U.S. Cl.
CPC ..... *F02P 5/145* (2013.01); *F02B 5/02* (2013.01); *F02P 3/0554* (2013.01); *F02P 11/06* (2013.01);
(Continued)

(58) Field of Classification Search
CPC ..... F02P 5/145; F02P 3/0554; F02P 11/06; F02P 15/006; F02P 15/10; F02P 5/00; F02P 2017/121; F02B 5/02
USPC ..... 123/211, 475, 598, 604, 606, 607, 620, 123/621, 628, 637, 639, 329, 406.11–39, 123/406.41–55, 406.7, 406.58–67, 406.71; 73/114.62, 114.67; 324/379, 395, 399
See application file for complete search history.

(56) References Cited

U.S. PATENT DOCUMENTS 3,945,362 A * 3/1976 Neuman ..... F02P 3/0453 123/606
5,007,397 A 4/1991 Akasu
(Continued)

FOREIGN PATENT DOCUMENTS

JP H04-259670 A 9/1992
JP H10-184520 A 7/1998
(Continued)

*Primary Examiner* — Thomas Moulis
*Assistant Examiner* — John Bailey
(74) *Attorney, Agent, or Firm* — Oliff PLC

(57) ABSTRACT

An ECU outputs an ignition signal Si to an ignition apparatus through an ignition communication line, and outputs a discharge waveform control signal Sc with a logic H through a waveform control communication line. The ignition apparatus performs the closing operation of an ignition switching element, in a period during which the ignition signal Si is input. In an input period of the discharge waveform control signal Sc after stopping the input of the ignition signal Si, the ignition apparatus controls the electric current to flow through a primary coil, by the opening-closing operation of a control switching element. When the voltage of the waveform control communication line Lc is the logic H in an output stop period of the discharge waveform control signal Sc, the ECU determines that the waveform control communication line is abnormal, and executes a fail-safe process.

4 Claims, 7 Drawing Sheets

(51) Int. Cl.

| | |
|---|---|
| ***F02B 5/02*** | (2006.01) |
| ***F02P 3/055*** | (2006.01) |
| ***F02P 11/06*** | (2006.01) |
| ***F02P 15/10*** | (2006.01) |
| *F02P 5/00* | (2006.01) |
| *F02P 17/12* | (2006.01) |

(52) U.S. Cl.
CPC ..... *F02P 15/006* (2013.01); *F02P 15/10* (2013.01); *F02P 5/00* (2013.01); *F02P 2017/121* (2013.01)

(56) References Cited

U.S. PATENT DOCUMENTS 5,365,910 A * 11/1994 Miyata ..... F02P 11/06 123/627
5,701,077 A * 12/1997 Inagaki ..... F02P 17/12 123/630
6,020,742 A * 2/2000 Kano ..... F02P 17/12 324/378
6,814,066 B2 * 11/2004 Ando ..... F02P 11/06 123/630
2003/0116148 A1 * 6/2003 Sakakura ..... F02P 3/051 123/630
2010/0122689 A1 * 5/2010 Tanaya ..... F02D 35/021 123/406.26
2011/0088646 A1 * 4/2011 Tanaya ..... F02P 5/15 123/179.3
2016/0047352 A1 * 2/2016 Nakayama ..... F02P 3/0453 123/406.19
2016/0061177 A1 * 3/2016 Ishitani ..... F02P 3/0435 123/623
2016/0084213 A1 * 3/2016 Nakayama ..... F02P 3/0442 123/634
2016/0084214 A1 * 3/2016 Okuda ..... F02D 37/02 123/478

FOREIGN PATENT DOCUMENTS

| | | | |
|---|---|---|---|
| JP | 2014-206061 | A | 10/2014 |
| JP | 2014-218995 | A | 11/2014 |
| WO | 2014/168239 | A1 | 10/2014 |
| WO | 2014/168244 | A1 | 10/2014 |

* cited by examiner t1-t3 t3-t4 t4-t5 t5-t6

IGNITION CONTROL SYSTEM FOR INTERNAL COMBUSTION ENGINE

INCORPORATION BY REFERENCE

The disclosure of Japanese Patent Application No. 2015-083556 filed on Apr. 15, 2015 including the specification, drawings and abstract is incorporated herein by reference in its entirety.

BACKGROUND

1. Technical Field

The disclosure relates to an ignition control system for an internal combustion engine that controls the discharge current of a spark plug after the discharge of the spark plug is started.

2. Description of Related Art

As this kind of ignition control system, for example, there is a system described in Japanese Patent Application Publication No. 2014-206061. In the system described in JP 2014-206061 A, an ignition signal is output from a control apparatus (ECU) to an ignition apparatus, so that the energization of a primary coil is performed. Then, when the output of the ignition signal is stopped, the energization of the primary coil is stopped, and therefore, counter electromotive force is generated in a secondary coil, resulting in the discharge of a spark plug. After the stop of the output of the ignition signal, the ECU outputs an energy input period signal (discharge waveform control signal) to the ignition apparatus. The ignition apparatus controls the discharge current of the spark plug, in a period during which the energy input period signal is input.

SUMMARY

In the above system, in the case where a communication line to transmit the energy input period signal shorts out with a member on an electric potential side corresponding to the logical value of the energy input period signal, the control of the discharge current of the spark plug is continued, even though the ECU does not perform an instruction of outputting the discharge current of the spark plug. Then, in this case, there are disadvantages in that wear of the spark plug is accelerated and the energy consumption rate rises.

The embodiments provide an ignition control system for an internal combustion engine that makes it possible to detect an abnormality of a waveform control communication line that transmits the discharge waveform control signal.

An ignition control system for an internal combustion engine according to a first aspect includes: an ignition apparatus including an ignition coil having a primary coil and a secondary coil, a spark coil connected with the secondary coil and communicating with a combustion chamber of the internal combustion engine, a discharge control circuit to continue discharge of the spark plug after a start of the discharge of the spark plug, and a discharge control unit to control a discharge current of the spark plug by operating the discharge control circuit, after the start of the discharge of the spark plug. In addition, an electronic control unit outputs an ignition signal and a discharge waveform control signal to the ignition apparatus, the ignition signal commanding energization of the primary coil, the discharge waveform control signal commanding control of the discharge current by the discharge control circuit. Furthermore, an ignition communication line transmits the ignition signal from the control apparatus to the ignition apparatus; and a waveform control communication line transmits the discharge waveform control signal from the control apparatus to the ignition apparatus. The electronic control unit is configured to determine whether the waveform control communication line is abnormal, based on at least one of (i) a condition that an electric potential of the waveform control communication line in a period during which the discharge waveform control signal is not output to the waveform control communication line corresponds to an electric potential when the discharge waveform control signal is output, and (ii) a condition that electric current flows through the primary coil or the secondary coil in a period other than a period during which the discharge waveform control signal is output to the waveform control communication line and a period during which the ignition signal is output to the ignition communication line.

In the above configuration, after the start of the discharge of the spark plug, the discharge control unit operates the discharge control circuit, and thereby, it is possible to continue the discharge of the spark plug. Here, for example, in the case where the waveform control communication line shorts out with a member that has an electric potential corresponding to the logical value of the discharge waveform control signal, the electric potential of the waveform control communication line becomes the electric potential of the discharge waveform control signal, in the period during which the control apparatus does not output the discharge waveform control signal. Further, in this case, the control of the discharge current is continued by the discharge control circuit. Therefore, although it is expected that the electric current does not usually flow through the primary coil and the secondary coil in the period other than the period during which the discharge waveform control signal is output to the waveform control communication line and the period during which the ignition signal is output to the ignition communication line, the electric current continues flowing even in the predetermined period.

The above configuration focuses on this point, and determines whether there is an abnormality, by the above-described operation of the electronic control unit. Therefore, it is possible to detect the abnormality of the waveform control communication line that transmits the discharge waveform control signal.

The ignition control system according to the above aspect may further include a switching apparatus configured to switch a connection state of the discharge control unit and an electric power source between a conduction state and an interruption state, and places the switching apparatus into the interruption state when it has been determined that the waveform control communication line is abnormal.

In the above configuration, in the case where the electronic control unit determines that the waveform control communication line is abnormal, the switching apparatus is placed into the interruption state. In this case, the discharge control unit cannot control the discharge current. Therefore, after the start of the discharge of the spark plug in response to an energization command for the primary coil by the ignition signal, the discharge current becomes zero more quickly, compared to the case where the discharge control unit controls the discharge current. Thereby, it is possible to suppress the discharge quantity of the spark plug, and to suppress wear of the spark plug.

In the ignition control system according to the above aspect, the electronic control unit may control an air-fuel ratio in the combustion chamber of the internal combustion engine to a first mode and a second mode, the first mode controlling the air-fuel ratio to a predetermined air-fuel ratio, and the second mode controlling the air-fuel ratio to an air-fuel ratio that is leaner than the predetermined air-fuel ratio of the first mode. In addition, the electronic control unit is configured to output the discharge waveform control signal in the second mode, and prohibit execution of the second mode when it has been determined that the waveform control communication line is abnormal.

In the above configuration, the execution of the second mode is prohibited. Therefore, the first mode, which exhibits a better ignitability than the second mode, is executed. Accordingly, it is possible to suitably suppress the occurrence of a situation in which the ignitability of fuel is low even though the switching apparatus is placed into an opened state and the discharge current is not controlled.

In the ignition control system according to the above first aspect, the electronic control unit may variably control a delay time of an input timing of the discharge waveform control signal to the ignition apparatus relative to an input timing of the ignition signal to the ignition apparatus, and thereby, variably control a discharge current value that is controlled by the discharge control unit depending on the delay time. In a case where the delay time is relatively long, the discharge control unit controls the discharge current value to a greater value than that in a case where the delay time is relatively short. When it has been determined that the waveform control communication line is abnormal, an upper limit of output of the internal combustion engine is decreased.

In the above configuration, at the time of the occurrence of an abnormality such as the short-circuit between the waveform control communication line and a member that has an electric potential corresponding to the logical value of the discharge waveform control signal, the above delay time is minimized, and therefore, the discharge current is controlled to a low value. Meanwhile, in the case where the speed of the internal combustion engine is low, the airflow in the combustion chamber is slow compared to the case where the speed of the internal combustion engine is high, and therefore, the discharge current is less easily carried by the airflow. Therefore, in the case where the speed of the internal combustion engine is low, the ignitability less easily decreases due to a low discharge current of the spark plug, compared to the case where the speed of the internal combustion engine is high.

Here, in the above configuration, by decreasing the upper limit of the output of the internal combustion engine, it is possible to suppress the occurrence of the decrease in the ignitability, even when the discharge control unit controls the discharge current to a low value.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
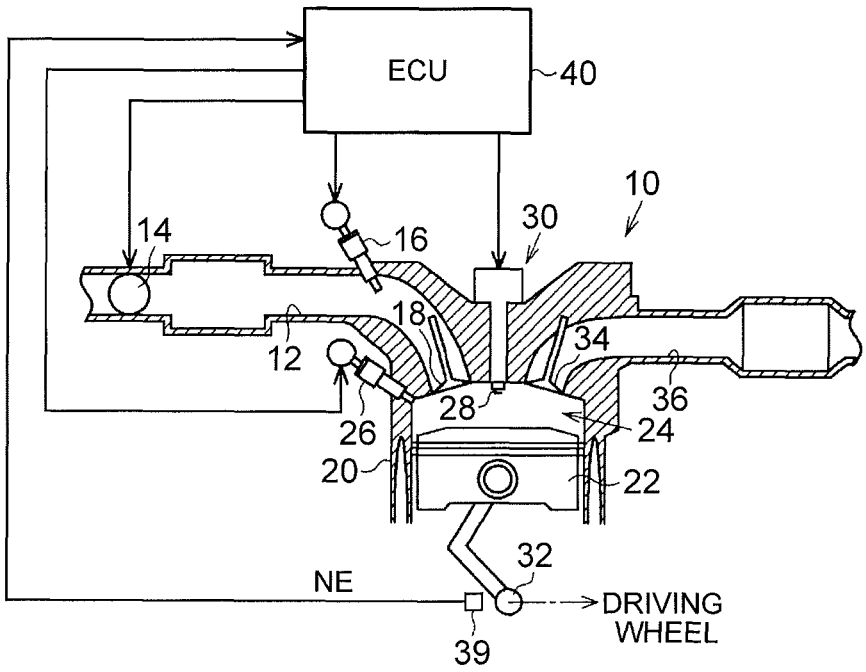
FIG. 1 is a diagram showing a configuration of an engine system that includes an ignition control system according to a first embodiment.

Hereinafter, a first embodiment of an ignition control system will be described with reference to the drawings. An internal combustion engine 10 shown in FIG. 1 is a spark-ignition multi-cylinder internal combustion engine. In an intake passage 12 of the internal combustion engine 10, an electronically-controlled throttle valve 14 capable of varying the cross-section area of the passage is provided. On the downstream side of the intake passage 12 relative to the throttle valve 14, a port injection valve 16 to inject fuel to an intake port is provided. The air in the intake passage 12 and the fuel injected from the port injection valve 16, by the valve opening operation of an intake valve 18, are filled into a combustion chamber 24 that is formed by a cylinder 20 and a piston 22. The combustion chamber 24 faces an injection port of a cylinder injection valve 26, and by the cylinder injection valve 26, the fuel can be injected and fed directly to the combustion chamber 24. In the combustion chamber 24, a spark plug 28 of an ignition apparatus 30 protrudes. Then, by the spark ignition of the spark plug 28, an air-fuel mixture of the air and the fuel is ignited, so that the air-fuel mixture undergoes combustion. Some of the combustion energy of the air-fuel mixture is converted into the rotational energy of a crankshaft 32, through the piston 22. To the crankshaft 32, a driving wheel of a vehicle can be mechanically linked. Here, in the embodiment, it is assumed that the vehicle is a vehicle in which only the internal combustion engine 10 gives dynamic power to the driving wheel.

The air-fuel mixture that has undergone combustion, by the valve opening operation of an exhaust valve 34, is ejected to an exhaust passage 36, as exhaust gas. An ECU 40 is a control apparatus that controls the internal combustion engine 10. The ECU 40 takes in output values of various sensors such as a crank angle sensor 39 that detects rotation speed NE of the crankshaft 32. Then, based on the taken output values, the ECU 40 operates various actuators such as the throttle valve 14, the port injection valve 16, the cylinder injection valve 26 and the ignition apparatus 30. The ECU 40 is an electronic control unit having, for example, a central processing unit (CPU) and memory such as ROM and RAM.

Figure 2:
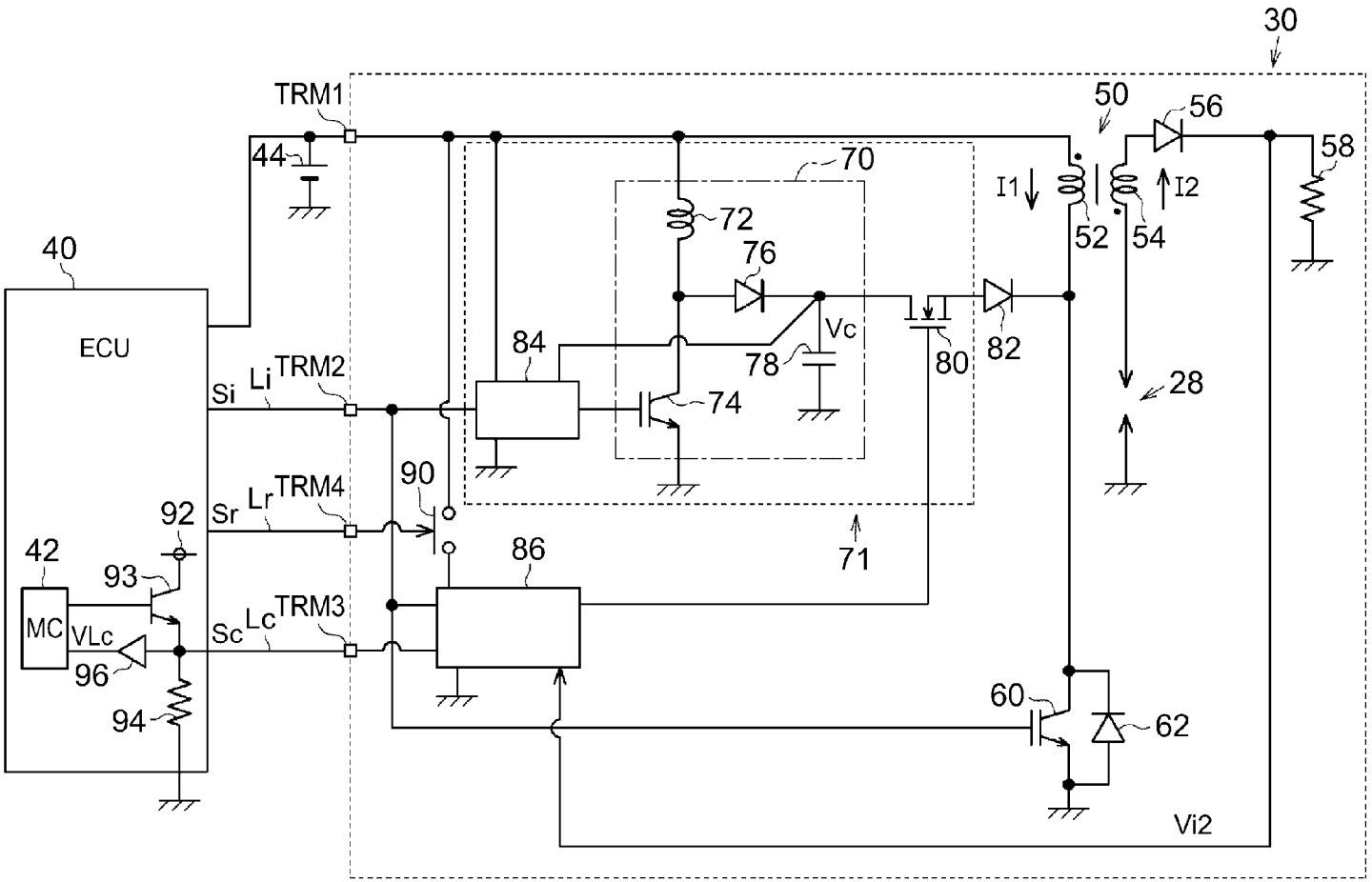
FIG. 2 is a circuit diagram showing a circuit configuration of the ignition control system according to the first embodiment.

FIG. 2 shows a circuit configuration of the ignition apparatus 30. As shown in FIG. 2, the ignition apparatus 30 includes an ignition coil 50 in which a primary coil 52 and a secondary coil 54 are magnetically coupled. Here, in FIG. 2, the black circles marked at one of a pair of terminals of the primary coil 52 and one of a pair of terminals of the secondary coil 54 show terminals at which the polarities of the electromotive forces to be generated in the primary coil 52 and the secondary coil 54 respectively are equal when the magnetic fluxes induced between the primary coil 52 and the secondary coil 54 are changed in a state in which both ends of the primary coil 52 and both ends of the secondary coil 54 are opened.

One terminal of the secondary coil 54 is connected with the spark plug 28, and the other terminal is grounded (connected to earth) through a diode 56 and a shunt resistor 58. The diode 56 is a rectifying element that permits the flow of electric current in a direction of going from the spark plug 28 through the secondary coil 54 to the earth and restricts the flow of electric current in the inverse direction. The shunt resistor 58 is a resistor for detecting the electric current flowing through the secondary coil 54 by a voltage drop Vi2 of the shunt resistor 58. In other words, the shunt resistor 58 is a resistor for detecting the discharge current of the spark plug 28.

One terminal of the primary coil 52 of the ignition coil 50 is connected with a positive electrode of an external battery 44 through a terminal TRM1 of the ignition apparatus 30. Further, the other terminal of the primary coil 52 is grounded (connected to earth) through an ignition switching element 60. Here, in the embodiment, the ignition switching element 60 is an insulated-gate bipolar transistor (IGBT). Further, with the ignition switching element 60, a diode 62 is connected in inverse parallel.

The electric power taken in from the terminal TRM1 is taken in also by a booster circuit 70. In the embodiment, the booster circuit 70 is configured by a boost chopper circuit. That is, an inductor 72 having one end connected with the terminal TRM1 side is included, and the other end of the inductor 72 is grounded (connected to earth) through a boost switching element 74. Here, in the embodiment, the boost switching element 74 is an IGBT. Between the inductor 72 and the boost switching element 74, the anode side of a diode 76 is connected. The cathode side of the diode 76 is grounded (connected to earth) through a capacitor 78. A charged voltage Vc of the capacitor 78 is the output voltage of the booster circuit 70.

A point between the diode 76 and the capacitor 78 is connected with a point between the primary coil 52 and the ignition switching element 60 through a control switching element 80 and a diode 82. In other words, an output terminal of the booster circuit 70 is connected with the point between the primary coil 52 and the ignition switching element 60 through the control switching element 80 and the diode 82. In the embodiment, the control switching element 80 is a MOS field-effect transistor. The above diode 82 is a rectifying element for blocking electric current from inversely flowing from the side of the primary coil 52 and the ignition switching element 60 to the side of the booster circuit 70 through a parasitic diode of the control switching element 80.

A boost control unit 84 is a drive circuit that controls the output voltage of the booster circuit 70 by performing the opening-closing operation of the boost switching element 74 based on an ignition signal Si input to a terminal TRM2. Here, the boost control unit 84 monitors the output voltage of the booster circuit 70 (the charged voltage Vc of the capacitor 78), and stops the opening-closing operation of the boost switching element 74, when the output voltage becomes a predetermined value or greater.

A discharge control unit 86 is a drive circuit that controls the discharge current of the spark plug 28 by performing the opening-closing operation of the control switching element 80 based on the ignition signal Si input to the terminal TRM2 and a discharge waveform control signal Sc input to a terminal TRM3. Discharge control unit 86 thus controls the discharge current of the spark plug 28 by controlling the control switching element 80, which is part of a discharge control circuit 71 that includes the boost control unit 84, the booster circuit 70 and the control switching element 80. Here, the electric power of the battery 44 taken in from the terminal TRM1 is input to the discharge control unit 86 through a relay 90. The relay 90 is an opening-closing apparatus in which the opening-closing operation is performed by an electric power source command signal Sr input to a terminal TRM4. In other words, the relay 90 is a switching apparatus (or switch) that switches between a conduction state (closed state) and an interruption state (opened state) for the connection between the discharge control unit 86 and the battery 44. When the relay 90 is put into the opened state (interruption state), the electric power source for the operation of the discharge control unit 86 is turned off.

The terminal TRM2 of the ignition apparatus 30 is connected with the ECU 40 through an ignition communication line Li, and the terminal TRM3 is connected with the ECU 40 through a waveform control communication line Lc. Further, the terminal TRM4 of the ignition apparatus 30 is connected with the ECU 40 through an electric power source communication line Lr.

Here, FIG. 2 specifies particularly the configuration of a part that is of the ECU 40 and that outputs the discharge waveform control signal Sc. That is, the ECU 40 includes a microcomputer (MC 42). Further, the ECU 40 includes an internal electric power source 92, and the internal electric power source 92 is grounded (connected to earth) through a bipolar transistor (command switching element 93) and a resistor 94. Then, the waveform control communication line Lc is connected with the connection point between the command switching element 93 and the resistor 94. Further, the ECU 40 includes a buffer 96. The buffer 96 takes in a voltage at the connection point between the command switching element 93 and the resistor 94, and converts the voltage into a voltage that can be detected by the MC 42.

In a first mode of controlling the air-fuel ratio of the internal combustion engine 10 to a first target air-fuel ratio (a theoretical air-fuel ratio, here), the ECU 40 outputs the ignition signal Si through the ignition communication line Li, and does not output the discharge waveform control signal Sc to the waveform control communication line Lc. Further, in a second mode of controlling the air-fuel ratio to a second target air-fuel ratio that is leaner than the first target air-fuel ratio, the ECU 40 outputs the ignition signal Si through the ignition communication line Li, and outputs the discharge waveform control signal Sc through the waveform control communication line Lc. Here, in the embodiment, both of the ignition signal Si and the discharge waveform control signal Sc are pulse signals with a logic H.

Figure 3:
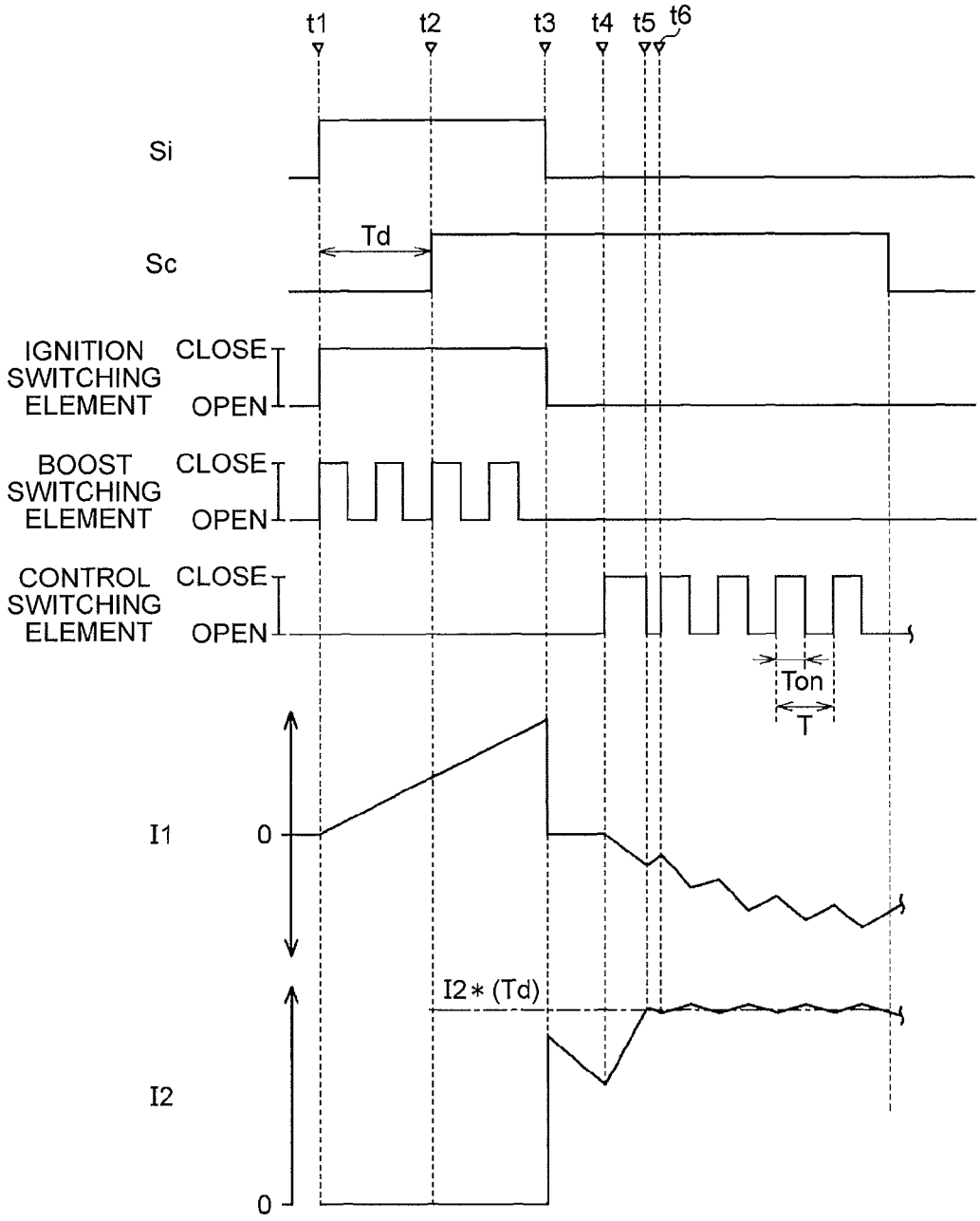
FIG. 3 is a timing chart exemplifying an ignition control according to the first embodiment.

Next, particularly, a control in the second mode of the ignition control according to the embodiment will be exemplified using FIG. 3 and FIG. 4A to FIG. 4D. FIG. 3 shows the transition of the ignition signal Si, the transition of the discharge waveform control signal Sc, the state transition of the opening-closing operation of the ignition switching element 60, the state transition of the opening-closing operation of the boost switching element 74, the state transition of the opening-closing operation of the control switching element 80, the transition of an electric current I1 to flow through the primary coil 52, and the transition of an electric current I2 to flow through the secondary coil 54. Here, as for the signs of the electric currents I1, I2, the sides pointed to by the arrows shown in FIG. 2 are defined to be positive.

Figure 4A:
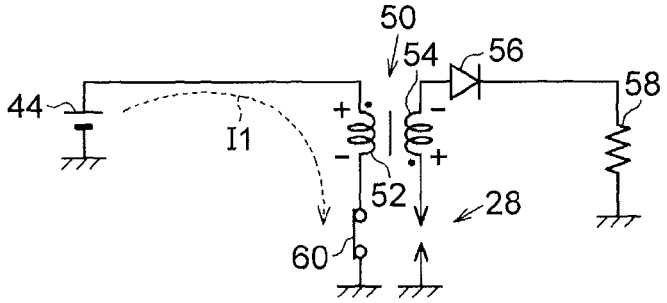
FIG. 4A to FIG. 4D are circuit diagrams exemplifying the ignition control according to the first embodiment.

When the ignition signal Si is input to the ignition apparatus 30 at time t1, the ignition apparatus 30 performs the turning-on (closing) operation of the ignition switching element 60. Thereby, the electric current I1 flowing through the primary coil 52 gradually increases. FIG. 4A shows the route of the electric current flowing through the primary coil 52 at this time. As shown in FIG. 4A, when the closing operation of the ignition switching element 60 is performed, a first loop circuit that is a loop circuit including the battery 44, the primary coil 52 and the ignition switching element 60 becomes a closed-loop circuit, and the electric current flows through this. Here, since the electric current flowing through the primary coil 52 gradually increases, the induced magnetic flux of the secondary coil 54 gradually increases. Therefore, an electromotive force to cancel the increase in the induced magnetic flux is generated in the secondary coil 54. However, the electromotive force makes the anode side of the diode 56 negative, and therefore, electric current does not flow through the secondary coil 54.

Further, as shown in FIG. 3, when the ignition signal Si is input to the ignition apparatus 30, the boost control unit 84 performs the opening-closing operation of the boost switching element 74. Thereafter, at time t2, which is the time when a delay time Td has elapsed from time t1 when the ignition signal Si was input to the ignition apparatus 30, the discharge waveform control signal Sc is input to the ignition apparatus 30.

Thereafter, when the input of the ignition signal Si is stopped at time t3, in other words, when the voltage of the ignition communication line Li is changed from the voltage of the logic H to the voltage of a logic L, the ignition apparatus 30 performs the opening operation of the ignition switching element 60. Thereby, the electric current I1 flowing through the primary coil 52 becomes zero, and by a counter electromotive force to be generated in the secondary coil 54, the electric current I2 flows through the secondary coil 54. Thereby, the spark plug 28 starts discharging.

Figure 4B:
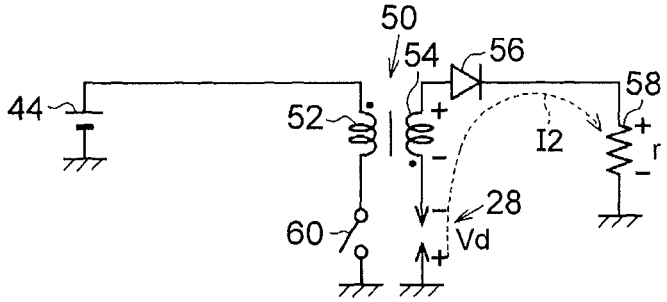

FIG. 4B shows the route of the electric current at this time. As shown in the figure, when the induced magnetic flux of the secondary coil 54 begins to decrease by the interruption of the electric current of the primary coil 52, a counter electromotive force in the direction of cancelling the decrease in the induced magnetic flux is generated in the secondary coil 54, and thereby, the electric current I2 flows through the spark plug 28, the secondary coil 54, the diode 56 and the shunt resistor 58. When the electric current I2 flows through the secondary coil 54, a voltage drop Vd is generated in the spark plug 28, and a voltage drop of "r·I2" corresponding to a resistance value r of the shunt resistor 58 is generated in the shunt resistor 58. Thereby, when the forward-directional voltage drop of the diode 56 and the like are ignored, a voltage of the sum "Vd+r·I2" of the voltage drop Vd in the spark plug 28 and the voltage drop in the shunt resistor 58 is applied to the secondary coil 54. The voltage gradually decreases the induced magnetic flux of the secondary coil 54. The gradual decrease in the electric current I2 to flow through the secondary coil 54 from time t3 to time t4 in FIG. 3 is a phenomenon that is caused by the application of the voltage of "Vd+r·I2" to the secondary coil 54.

Figure 4C:
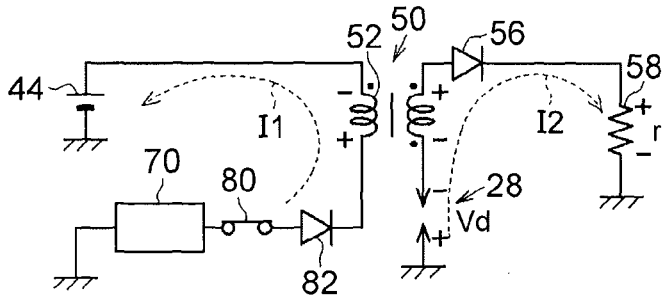

As shown in FIG. 3, after time t4, the discharge control unit 86 performs the opening-closing operation of the control switching element 80. FIG. 4C shows the electric current route in a period from time t4 to time t5 during which the control switching element 80 is in the closed state. Here, a second loop circuit that is a loop circuit including the booster circuit 70, the control switching element 80, the diode 82, the primary coil 52 and the battery 44 becomes a closed loop, and the electric current flows through this.

Figure 4D:
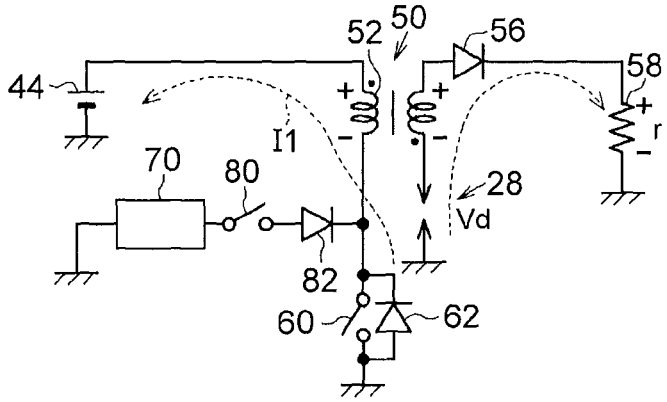

FIG. 4D shows the electric current route in a period from time t5 to time t6 during which the control switching element 80 is in the opened state. Here, a counter electromotive force to cancel the change in magnetic flux that is caused by the decrease in the absolute value of the electric current flowing through the primary coil 52 is generated in the primary coil 52. Thereby, a third loop circuit that is a loop circuit including the diode 62, the primary coil 52 and the battery 44 becomes a closed loop, and the electric current flows through this.

Here, by controlling a time ratio D of a closing operation period Ton to one cycle T of the opening-closing operation of the control switching element 80 shown in FIG. 3, it is possible to control the electric current flowing through the primary coil 52. The discharge control unit 86 executes a control to gradually increase the absolute value of the electric current I1 flowing through the primary coil 52, by controlling the time ratio D. The electric current I1 in the period has the inverse sign to the electric current I1 flowing through the primary coil 52 when the ignition switching element 60 is in the closed state. Therefore, if the magnetic flux that is generated by the electric current I1 flowing through the primary coil 52 when the ignition switching element 60 is in the closed state is defined to be positive, the electric current I1 generated by the opening and closing of the control switching element 80 decreases the magnetic flux. Here, in the case where the gradual decrease rate of the induced magnetic flux of the secondary coil 54 by the electric current I1 flowing through the primary coil 52 coincides with the gradual decrease rate when the voltage of "Vd+r·I2" is applied to the secondary coil 54, the electric current flowing through the secondary coil 54 does not decrease. In this case, the electric power loss by the spark plug 28 and the shunt resistor 58 is compensated by the electric power that is output by an electric power source constituted by the booster circuit 70 and the battery 44.

On the contrary, in the case where the gradual decrease rate of the induced magnetic flux of the secondary coil 54 by the electric current I1 flowing through the primary coil 52 is lower than the gradual decrease rate when the voltage of "Vd+r·I2" is applied to the secondary coil 54, the electric current I2 flowing through the secondary coil 54 gradually decreases. By the gradual decrease in the electric current I2, the induced magnetic flux gradually decreases at the gradual decrease rate when the voltage of "Vd+r·I2" is applied to the secondary coil 54. However, the gradual decrease rate in the electric current I2 flowing through the secondary coil 54 is lower compared to the case where the absolute value of the electric current I1 flowing through the primary coil 52 does not gradually decrease.

Further, in the case where the absolute value of the electric current I1 flowing through the primary coil 52 is gradually increased such that the gradual decrease rate of the actual induced magnetic flux is higher than the gradual decrease rate of the induced magnetic flux of the secondary coil 54 when the voltage of "Vd+r·I2" is applied to the secondary coil 54, the voltage of the secondary coil 54 becomes high by a counter electromotive force to suppress the decrease in the induced magnetic flux. Then, the electric current I2 flowing through the secondary coil 54 increases such that "Vd+r·I2" becomes equal to the voltage of the secondary coil 54.

Thus, by controlling the gradual increase rate of the absolute value of the electric current I1 flowing through the primary coil 52, it is possible to control the electric current I2 flowing through the secondary coil 54. In other words, it is possible to control the discharge current of the spark plug 28 for both the increase and the decrease.

The discharge control unit 86 manipulates the above time ratio D of the control switching element 80 for feedback control of the discharge current value decided from the voltage drop Vi2 of the shunt resistor 58 to a discharge current command value I2*.

Here, the ignition communication line Li, the ignition coil 50, the spark plug 28, the ignition switching element 60, the diode 62, the control switching element 80 and the diode 82 shown in FIG. 2 are provided for each cylinder, but FIG. 2 shows only one representatively. In the embodiment, as for the waveform control communication line Lc, the booster circuit 70, the boost control unit 84 and the discharge control unit 86, a single member is allocated for multiple cylinders. Then, depending on what cylinder the ignition signal Si input to the ignition apparatus 30 corresponds to, the discharge control unit 86 selects and operates the corresponding control switching element 80. Further, the boost control unit 84 performs the boost control, when the ignition signal Si for any cylinder is input to the ignition apparatus 30.

With the condition that the ignition signal Si is not input, the discharge control unit 86 controls the discharge current to the discharge current command value I2*, in a period after the elapse of a specified time from a falling edge of the ignition signal Si and before a falling edge of the discharge waveform control signal Sc. Then, as shown in FIG. 3, the discharge control unit 86 variably sets the discharge current command value I2*, depending on the delay time Td of the timing when the discharge waveform control signal Sc is input to the ignition apparatus 30 relative to the timing when the ignition signal Si is input to the ignition apparatus 30. Thereby, the ECU 40 can variably set the discharge current command value I2* by varying the delay time Td.

In detail, in the embodiment, as the rotation speed NE is higher, the ECU 40 sets the discharge current command value I2* to a greater value, and elongates the delay time Td. This is a setting in consideration of the fact that, in the case of a high rotation speed NE, the ignitability decreases because the airflow in the combustion chamber 24 becomes faster than that in the case of a low speed NE.

Figure 5:
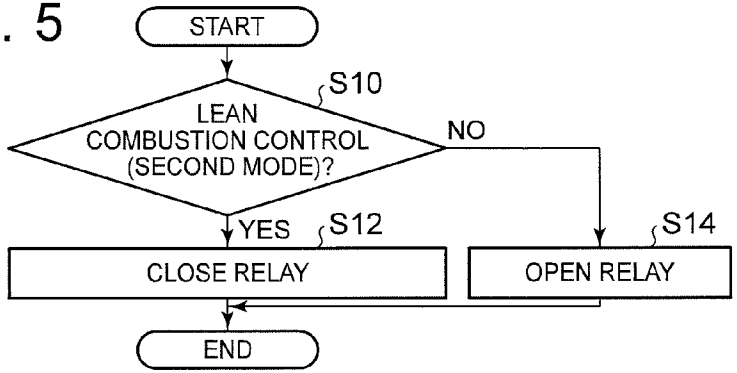
FIG. 5 is a flowchart showing a procedure of an opening-closing process of a relay according to the first embodiment.

FIG. 5 shows a procedure of an opening-closing process of the relay 90 by the ECU 40. The process is executed repeatedly in a predetermined cycle, for example, by the ECU 40. In the series of processes, the ECU 40 determines whether the mode is the second mode, in which a lean combustion control is performed (S10). Then, in the case of being the second mode (S10: YES), the ECU 40 performs the closing operation of the relay 90 (S12). Thereby, the battery 44 and the discharge control unit 86 are put into the conduction state, and the electric power is input to the discharge control unit 86. Therefore, the discharge control unit 86 can control the discharge current of the spark plug 28. On the other hand, in the case of being not the second mode (S10: NO), the ECU 40 performs the opening operation of the relay 90 (S14). Thereby, the battery 44 and the discharge control unit 86 are put into the interruption state, and the electric power source for the operation of the discharge control unit 86 is turned off. Therefore, it is possible to suppress or avoid a situation in which the electric power is consumed by the discharge control unit 86 when the discharge waveform control signal Sc is not output.

Here, when the process of the above step S12 or step S14 is completed, the series of processes are finished once. The ECU 40 executes an abnormality determination process that is a process of determining whether there is an abnormality in which the voltage of the waveform control communication line Lc is constantly the voltage corresponding to the logic H because of a short-circuit between the waveform control communication line Lc and the battery 44, for example.

Figure 6:
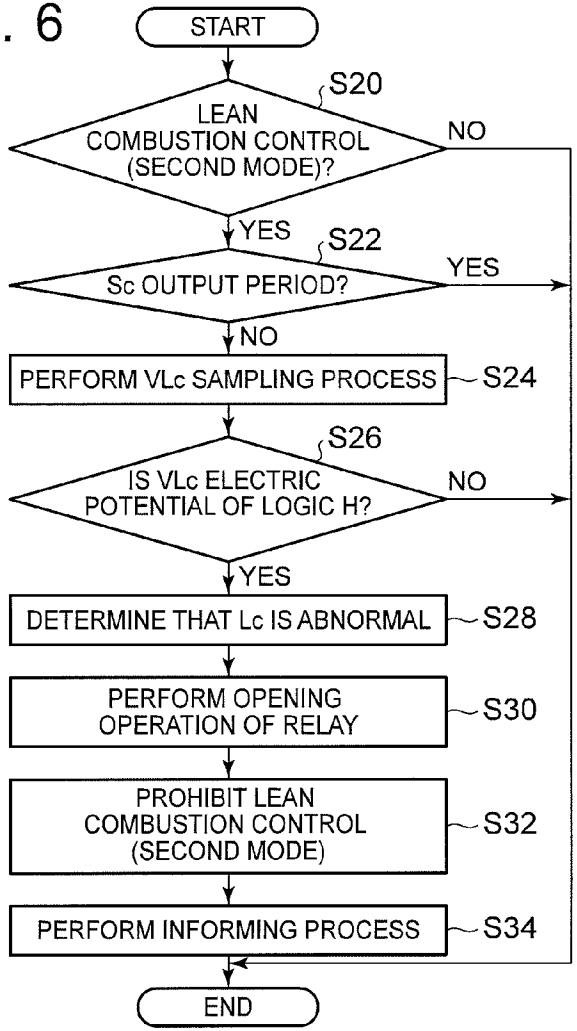
FIG. 6 is a flowchart showing a procedure of an abnormality determination process and a fail-safe process according to the first embodiment.

FIG. 6 shows a procedure of the above abnormality determination process and a fail-safe process that is executed in the case where an abnormality determination is made. The processes are executed repeatedly in a predetermined cycle, for example, by the MC 42 of the ECU 40.

In the series of processes, the MC 42, first, determines whether the mode is the second mode (S20). Then, in the case of determining that the mode is the second mode (S20: YES), the MC 42 determines whether the current time is in an output period of the discharge waveform control signal Sc (S22). The process is a process for determining whether the current time is in a period during which the voltage of the waveform control communication line Lc corresponds to the logic L if the waveform control communication line Lc is not abnormal. The process is a process for determining whether the current time is in a period during which the MC 42 performs the opening operation of the command switching element 93. That is, in the case of the period during which the MC 42 performs the opening operation of the command switching element 93, the voltage of the waveform control communication line Lc is reduced to 0 V by the resistor 94, and therefore, it is expected that the voltage of the waveform control communication line Lc is the voltage of the logic L, which is the voltage in the period during which the discharge waveform control signal Sc is not output.

Then, in the case of determining that the current time is not in the output period of the discharge waveform control signal Sc (S22: NO), the MC 42 samples a voltage VLc output from the buffer 96 (S24). Then, the MC 42 determines whether the sampled voltage VLc is the logic H level (S26). Here, the voltage VLc output from the buffer 96 is a voltage after the voltage of the waveform control communication line Lc is converted into a value capable of being detected by the MC 42, and therefore, can be different in magnitude from the actual voltage of the waveform control communication line Lc. Therefore, the MC 42 determines whether the sampled voltage VLc is the logic H level, based on the magnitude comparison between the voltage VLc and a threshold decided depending on the voltage after the voltage of the waveform control communication line Lc when the discharge waveform control signal Sc is output is converted by the buffer 96.

In the case of determining that the sampled voltage VLc is the logic H level (S26: YES), the MC 42 determines that the waveform control communication line Lc is abnormal (S28). Then, as the fail-safe process, the MC 42, by the electric power source command signal Sr, performs the opening operation of the relay 90 to perform the switching to the interruption state between the battery 44 and the discharge control unit 86 (S30). This is a process for preventing the discharge control unit 86 from performing the opening-closing operation of the control switching element 80 in the case where the voltage of the waveform control communication line Lc is constantly the logic H.

Further, as the fail-safe process, the MC 42 executes a process of prohibiting the control in the second mode (S32). That is, the combustion control of the internal combustion engine 10 is performed in the first mode. This is because the ignitability decreases more easily in the second mode than in the first mode in the case where the discharge control unit 86 does not perform the control of the discharge current.

Further, as the fail-safe process, the MC 42 executes an informing process of informing a user that an abnormality has occurred in the waveform control communication line Lc (S34). The process, for example, may be a process of lighting an alarm lamp.

Here, in the case where the process of step S34 is completed, in the case where the negative determination is made in steps S20, S26, or in the case where the positive determination is made in step S22, the MC 42 finishes the series of processes once.

Here, functions of the embodiment will be described. In the second mode, the ECU 40 outputs the discharge waveform control signal Sc, in addition to the ignition signal Si. Further, in the case where the voltage of the waveform control communication line Lc is the logic H in the period during which the discharge waveform control signal Sc is not output, the ECU 40 determines that the waveform control communication line Lc is abnormal, and executes the fail-safe process.

According to the embodiment described above, the following effects are obtained. (1) In the case where the voltage of the waveform control communication line Lc is the voltage of the logic H in the period during which the discharge waveform control signal Sc is not output, the determination that the waveform control communication line Lc is abnormal is made. Thereby, it is possible to detect the abnormality of the waveform control communication line Lc that transmits the discharge waveform control signal Sc.

(2) As the fail-safe process, the relay 90 is put into the opened state (the relay 90 is switched to the interruption state between the battery 44 and the discharge control unit 86). Thereby, even when the voltage of the signal to be input from the waveform control communication line Lc to the ignition apparatus 30 is continuously the logic H, the discharge control unit 86 does not operate, and therefore, the opening-closing operation of the control switching element 80 is not performed. Therefore, it is possible to decrease the electric power that is consumed by the discharge control unit 86. Further, it is possible to suppress the discharge quantity of the spark plug 28, and to suppress wear of the spark plug 28.

(3) As the fail-safe process, the execution of the second mode is prohibited. The first mode exhibits a better ignitability than the second mode, and therefore, a high ignitability is easily maintained even when the control of the discharge current is not performed. Therefore, by prohibiting the execution of the second mode, it is possible to suitably suppress the occurrence of a situation in which the ignitability is low.

(4) Whether there is an abnormality is determined in the second mode. Therefore, in the case where an abnormality occurs in the waveform control communication line Lc in the middle of the second mode, it is possible to quickly detect the abnormality, and to quickly deal with the abnormality.

Hereinafter, a second embodiment of the ignition control system will be described with a focus on differences from the first embodiment, with reference to the drawings.

Figure 7:
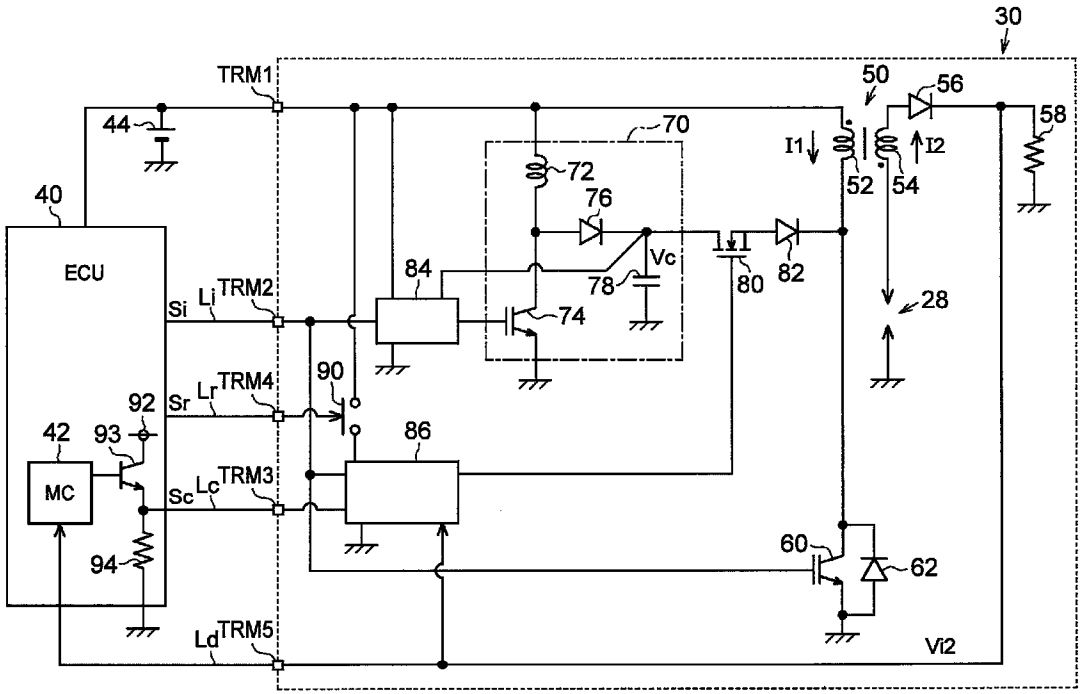
FIG. 7 is a circuit diagram showing a circuit configuration of an ignition control system according to a second embodiment.

FIG. 7 shows a circuit configuration of the ignition apparatus 30 according to the second embodiment. Here, in FIG. 7, for members corresponding to members shown in FIG. 2, identical reference characters are assigned, for convenience sake. As shown in the figure, in the embodiment, the MC 42 takes in the voltage drop Vi2 of the shunt resistor 58, through a terminal TRM5 and a detection communication line Ld.

Figure 8:
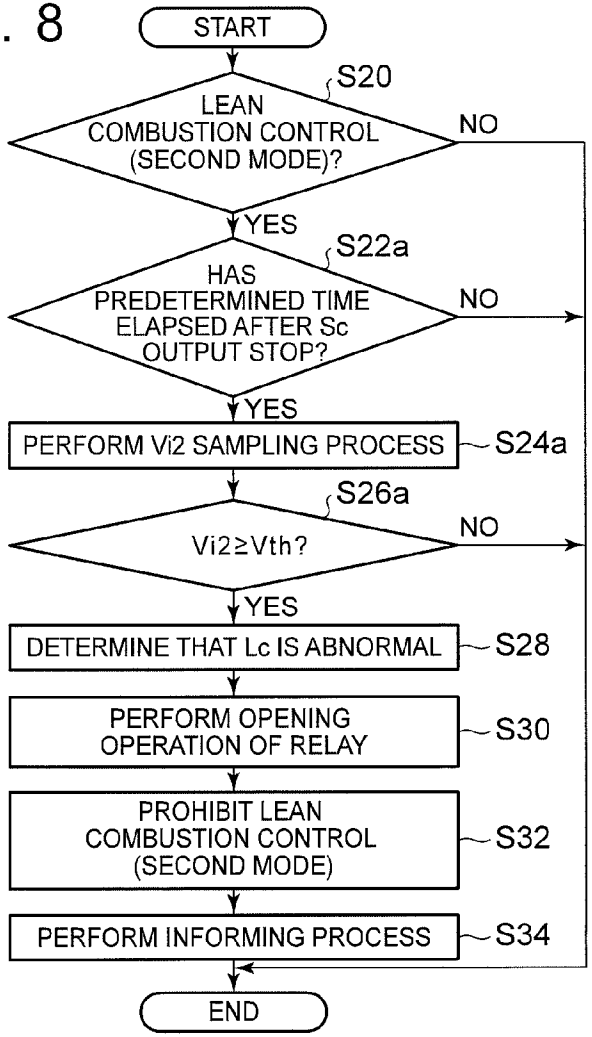
FIG. 8 is a flowchart showing a procedure of an abnormality determination process and a fail-safe process according to the second embodiment.

FIG. 8 shows a procedure of an abnormality determination process and a fail-safe process that is executed in the case where an abnormality determination is made according to the second embodiment. The processes are executed repeatedly in a predetermined cycle, for example, by the MC 42 of the ECU 40. Here, in the processes shown in FIG. 8, for processes corresponding to processes shown in FIG. 6, identical step numbers are assigned, for convenience sake.

In the series of processes shown in FIG. 8, in the case of determining that the mode is the second mode (S20: YES), the MC 42 determines whether a predetermined time has elapsed after the stop of the output of the discharge waveform control signal Sc (S22*a*). The process is a process of determining whether the electric current to flow through the secondary coil 54 is zero. Here, the predetermined time is set so as to be equal to or greater than a time that is assumed to be required after the control of the discharge current is finished by the stop of the output of the discharge waveform control signal Sc and before the electric current to flow through the secondary coil 54 becomes zero. Then, in the case of determining that the predetermined time has elapsed (S22*a*: YES), the MC 42 executes a sampling process of sampling the voltage drop Vi2 of the shunt resistor 58 (S24*a*). Subsequently, the MC 42 determines whether the voltage drop Vi2 is a threshold voltage Vth or greater (S26*a*). The process is a process for determining whether the electric current is flowing through the secondary coil 54. The threshold voltage Vth only needs to be set to a value that is slightly greater than zero. Then, in the case of determining that the voltage drop Vi2 is the threshold voltage Vth or greater (S26*a*: YES), the MC 42 determines that the waveform control communication line Lc is abnormal because the electric current is flowing through the secondary coil 54 (S28).

Here, in the case of making the negative determination in steps S22*a*, S26*a*, the MC 42 finishes the series of processes once.

Figure 9:
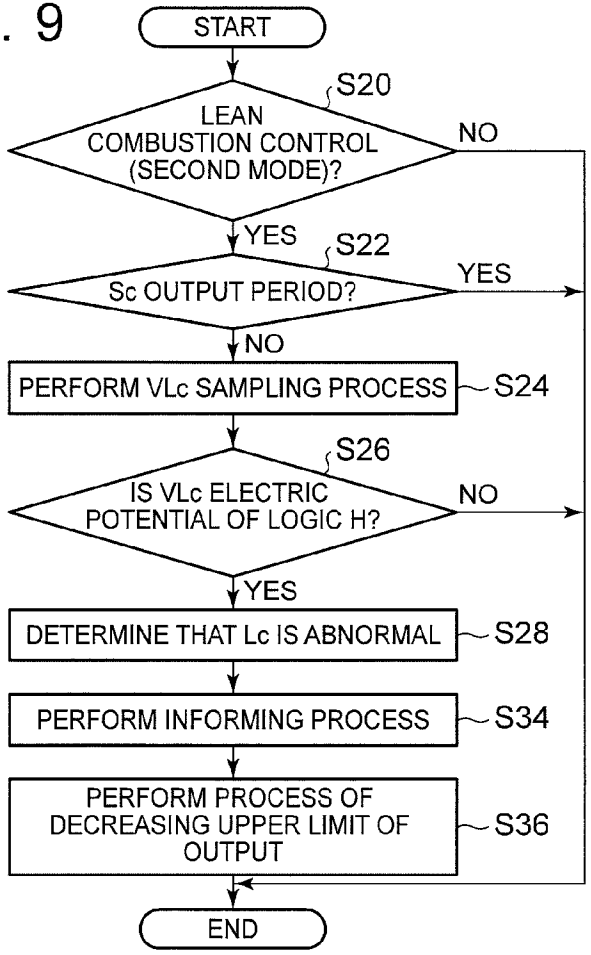
FIG. 9 is a flowchart showing a procedure of an abnormality determination process and a fail-safe process according to a third embodiment.

Hereinafter, a third embodiment of the ignition control system will be described with a focus on differences from the first embodiment, with reference to the drawings. In the third embodiment, the fail-safe process is changed from the first embodiment. FIG. 9 shows a procedure of an abnormality determination process and a fail-safe process that is executed in the case where an abnormality determination is made according to the third embodiment. The processes are executed repeatedly in a predetermined cycle, for example, by the MC 42 of the ECU 40. Here, in the processes shown in FIG. 9, for processes corresponding to processes shown in FIG. 6, identical step numbers are assigned, for convenience sake.

In the series of processes shown in FIG. 9, in the case of determining that there is an abnormality (S28), the MC 42 executes the informing process (S34), and also, executes a process of decreasing the upper limit of the output of the internal combustion engine 10 (S36), as the fail-safe process. Specifically, the MC 42 executes the process of decreasing the upper limit of the product of the torque and the speed. By the process, in the case where a request to increase the output of the internal combustion engine 10 is generated in response to an accelerator operation by a user, the output sometimes becomes smaller than the requested output of the user, although the output in accordance with the request is possible at the normal time. However, in the case where the output requested to the internal combustion engine 10 in response to the accelerator operation is smaller than the upper limit, the output is performed in accordance with the request.

Here, functions of the embodiment will be described. In the case of determining that the waveform control communication line Lc is abnormal, the MC 42 executes the process of decreasing the upper limit of the output of the internal combustion engine 10, in addition to the informing process. Here, the informing process plays a role in informing a user that the output of the internal combustion engine 10 is restricted, in addition to a role in informing the user that the waveform control communication line Lc is abnormal.

Here, in the embodiment, when the voltage of the waveform control communication line Lc is constantly the voltage of the logic H, the ignition apparatus 30 sets, to zero, the delay time Td of the input timing of the discharge waveform control signal Sc relative to the input timing of the ignition signal Si, and employs the minimum value as the discharge current command value I2*. Meanwhile, in the case where the speed of the internal combustion engine 10 is high, the airflow in the combustion chamber 24 becomes fast, and therefore, the discharge current is easily carried by the airflow. Therefore, it is necessary to increase the discharge current, for suppressing the decrease in the ignitability due to the stop of the discharge. In response, the restriction of the output makes it possible to suppress the decrease in the ignitability, also by the discharge current command value I2* when the delay time Td is zero. Therefore, it is possible to suppress the decrease in drivability due to misfire.

Furthermore, in the case where the upper limit of the output of the internal combustion engine 10 is decreased, it is possible to reduce the electric current to flow through the primary coil 52, by the feedback control of the discharge current from the discharge control unit 86, compared to the case where the upper limit is not decreased. This is for the following reason.

That is, in the case where the rotation speed NE of the internal combustion engine 10 is low, the airflow in the combustion chamber 24 is slow compared to the case where the speed NE of the internal combustion engine 10 is high, and therefore, the discharge current is less easily carried by the airflow. Therefore, in the case where the speed NE of the internal combustion engine 10 is low, the control to the discharge current command value I2* is possible even when the electromotive force of the secondary coil 54 is low, compared to the case where the rotation speed NE of the internal combustion engine 10 is high. Further, in the case where the load of the internal combustion engine 10 is low, the voltage drop between a pair of electrodes of the spark plug 28 in the case of an identical rotation speed NE and an identical discharge current of the spark plug 28 is small, compared to the case where the load of the internal combustion engine 10 is high. Therefore, in the case where the load of the internal combustion engine 10 is low, the control to the discharge current command value I2* is possible even when the electromotive force of the secondary coil 54 is low, compared to the case where the load of the internal combustion engine 10 is high. Accordingly, it is possible to suppress the increase in the electric current of the primary coil 52 due to the feedback control.

Therefore, it is possible to suppress wear of the primary coil 52 and the like, and it is possible to suppress the waste of the electric power. Here, at least one of the aspects of the above embodiments may be modified as follows. In the following, there are parts in which correspondence relations between aspects described in the section "SUMMARY" and aspects in the above embodiments are exemplified by reference characters and the like, but it is not intended to limit the above aspects to the exemplified correspondence relations. Incidentally, the switching apparatus in the above second aspect of the section "SUMMARY" corresponds to the relay 90.

As for the period of performing the abnormality determination, for example, whether there is an abnormality may be determined only in the first mode in which the theoretical air-fuel ratio is the target air-fuel ratio, or whether there is an abnormality may be determined in both of the first mode and the second mode.

As for the detection technique for the electric current, the embodiments are not limited to a configuration in which the voltage drop (voltage effect Vi2) of the shunt resistor 58 is utilized as the detection value of the electric current of the secondary coil 54. For example, a current transformer may be provided between the secondary coil 54 and the diode 56, and the electric current value to be detected by the current transformer may be used.

The embodiments are not limited to a configuration of using the detection value of the electric current of the secondary coil 54. For example, the detection value of the electric current flowing through the primary coil 52 may be used. Even this case can use the detection value of the electric current in a predetermined period after the stop of the output of the discharge waveform control signal Sc and before the next output of the ignition signal Si. Here, the electric current of the primary coil 52, for example, may be detected by a current transformer or the like.

As for the abnormality determination technique, for example, both of the abnormality determination process based on the voltage VLc shown in the first embodiment and the abnormality determination process based on the voltage drop Vi2 shown in the second embodiment may be executed.

In the above third embodiment (FIG. 9), the upper limit of the product of the torque and speed of the internal combustion engine 10 is decreased, but the embodiments are not limited to this. For example, as for the load, a high load may be permitted, and the upper limit of the speed may be set to a value that is smaller than a maximum permissible speed before the abnormality determination is performed. Further, for example, as for the speed, a high speed may be permitted, and the upper limit of the load may be set to a value that is smaller than a maximum permissible speed before the abnormality determination is performed. In the case where only the upper limit of the load is decreased, the speed can become high. However, for example, if the discharge current command value I2* is increased as the delay time Td is shorter, or if the discharge current command value I2* is output from the ECU 40 to the ignition apparatus 30 through a separate communication line, there is no problem that is caused by the reduction in the discharge current command value I2*. However, in the case where the load is high, the voltage between the electrodes of the spark plug 28 is higher than that in the case where the load is low, even when the control to an identical discharge current is performed. Therefore, it is desirable to raise the gradual increase rate of the absolute value of the electric current to flow through the primary coil 52. Accordingly, the restriction of the upper limit of the load is effective in restricting the electric current to flow through the primary coil 52.

In the above third embodiment, the control in the second mode may be prohibited. Further, instead of this, the relay 90 may be put into the opened state. Further, in the first embodiment, a configuration in which the relay 90 is not included may be adopted, and a process of prohibiting the control in the second mode may be performed.

The embodiments are not limited to the pulse signal with the logic "H", and for example, a pulse signal with the logic "L" may be adopted. In this case, the discharge current value only needs to be specified by the delay time of the input timing of a falling edge of the discharge waveform control signal Sc relative to the input timing of the ignition signal Si to the ignition apparatus 30.

Here, it is not essential that the discharge waveform control signal commands the discharge current value. For example, the discharge waveform control signal may command only the finish timing of the control of the discharge current. Further, for example, the discharge waveform control signal may command the start timing of the control of the discharge current by a rising edge, and may command the above finish timing by a falling edge.

In the above embodiments, the pull-up of the waveform control communication line Lc is performed by the internal electric power source 92 through the command switching element 93, but the embodiments are not limited to this. For example, the pull-up of the waveform control communication line Lc may be performed by the internal electric power source 92 through a pull-up resistor, and the command switching element 93 may be provided between the waveform control communication line Lc and the earth. In this case, when the command switching element 93 is turned off, the electric potential of the waveform control communication line Lc becomes the logic H. Here, in this case, the pull-up of the waveform control communication line Lc may be performed by the electric power source of the ignition apparatus 30 side, instead of the internal electric power source 92.

The ignition signal is not limited to the pulse signal with the logic "H", and for example, may be a pulse signal with the logic "L". The ignition switching element 60 may be disposed between the terminal TRM1 and the primary coil 52. In this case, even when the ignition signal Si is not input, the ignition switching element 60 is opened and closed in synchronization with the opening-closing operation of the control switching element 80, in a period during which the discharge waveform control signal Sc is input. The ignition switching element may be configured by a MOS field-effect transistor.

The control switching element 80 may be replaced with a pair of MOS field-effect transistors in which anodes or cathodes of body diodes are shorted out with each other, and the diode 82 may be removed. Further, an IGBT may be adopted.

In the above embodiments, the start timing of the control of the discharge current is the timing when the specified time has elapsed from the falling edge of the ignition signal Si, but the embodiments are not limited to this. For example, the start timing of the control may be the falling edge of the ignition signal Si.

The embodiments are not limited to a configuration in which the booster circuit 70 and the battery 44 are used for the application of the voltage to the primary coil. For example, the embodiments may include a circuit in which the battery 44 and the primary coil 52 can be connected such that a voltage with the reverse polarity to the polarity at the time of the closing operation of the ignition switching element 60 is applied to the primary coil 52.

The embodiments are not limited to a configuration in which the primary coil 52 is energized for the control of the discharge current of the spark plug 28. For example, differently from the primary coil 52, a third coil magnetically coupled with the secondary coil 54 may be energized. In this case, both ends of the third coil are insulated in a period during which the closing operation of the ignition switching element 60 is performed, and the same energization as the energization of the primary coil 52 in the above embodiments is performed after the opening operation of the ignition switching element 60.

The embodiments are not limited to a configuration of performing the feedback control of the detection value of the discharge current value to the discharge current command value I2*, and may adopt a configuration of performing the open loop control to the discharge current command value I2*. This can be actualized by variably setting the time ratio of the opening-closing operation of the control switching element 80 depending on the discharge current command value I2*.

The booster circuit is not limited to the boost chopper circuit, and may be a boost/buck chopper circuit. This can be actualized, for example, by replacing the diode 76 and the boost switching element 74 with MOS field-effect transistors. Then, if the opening-closing operations of the pair of MOS field-effect transistors are complementarily performed, even when the opening-closing operations are continued in the first mode in which the discharge waveform control signal Sc is not output, the charged voltage Vc of the capacitor 78 is restricted to a value decided by the time ratio, and therefore, an excessive voltage is suppressed.

The embodiments are not limited to a configuration in which the discharge of the spark plug 28 does not occur when the ignition switching element 60 is in the closed state. For example, in the closed state of the ignition switching element 60, the discharge may be performed from one electrode of the spark plug 28 to the other electrode, and by the opening operation of the ignition switching element 60, the discharge may be performed from the above other electrode to the one electrode by the counter electromotive force generated in the secondary coil 54. Even in this case, the decision of the discharge current command value depending on the above delay time Td is effective in the case where the discharge current value is controlled after the start of the discharge from the other electrode to the one electrode.

As the first mode in which the air-fuel ratio is richer than that in the second mode in which the control of the discharge current is executed, the embodiments are not limited to a configuration in which the air-fuel ratio is controlled to the theoretical air-fuel ratio. The air-fuel ratio may be richer than that, or may be leaner. In short, the air-fuel ratio only needs to be richer than that in the second mode.

Furthermore, the embodiments are not limited to a configuration in which the control of the discharge current is executed only in a period in which the air-fuel ratio is leaner than others. For example, at the time of a high revolution and a high load, the control of the discharge current may be executed, even when the target air-fuel ratio is set to the richest air-fuel ratio.

In the case where the internal combustion engine includes a TCV, a SCV or the like, which increases the airflow in the combustion chamber, it is preferable to control the discharge current.

The internal combustion engine is not limited to an internal combustion engine that gives dynamic power to the driving wheel of the vehicle, and may be an internal combustion engine that is mounted in a series hybrid vehicle, for example.

The internal combustion engine may include an actuator that controls the airflow in the combustion chamber, as exemplified by a tumble control valve (TCV) and a swirl control valve (SCV).

What is claimed is:

1. An ignition control system for an internal combustion engine, the ignition control system comprising:

an ignition apparatus including an ignition coil having a primary coil and a secondary coil, a spark plug connected with the secondary coil, the spark plug communicating with a combustion chamber of the internal combustion engine, a discharge control circuit configured to continue discharge of the spark plug after a start of the discharge of the spark plug, and a discharge control unit configured to control a discharge current of the spark plug by operating the discharge control circuit, after the start of the discharge of the spark plug;

an electronic control unit configured to output an ignition signal and a discharge waveform control signal to the ignition apparatus, the ignition signal commanding energization of the primary coil, and the discharge waveform control signal commanding control of the discharge current by the discharge control circuit;

an ignition communication line configured to transmit the ignition signal from the electronic control unit to the ignition apparatus;

a waveform control communication line configured to transmit the discharge waveform control signal from the electronic control unit to the ignition apparatus; and a switching apparatus configured to switch a connection state of the discharge control unit and an electric power source between a conduction state and an interruption state, wherein the electronic control unit is configured to determine whether the waveform control communication line is abnormal, based on at least one of i) a condition that an electric potential of the waveform control communication line in a period during which the discharge waveform control signal is not output to the waveform control communication line corresponds to an electric potential when the discharge waveform control signal is output and ii) a condition that electric current flows through the primary coil or the secondary coil in a period other than a period during which the discharge waveform control signal is output to the waveform control communication line and a period during which the ignition signal is output to the ignition communication line, and the electronic control unit is configured to place the switching apparatus into the interruption state when it has been determined that the waveform control communication line is abnormal.

2. The ignition control system according to claim 1, wherein the electronic control unit is configured to i) control an air-fuel ratio in the combustion chamber of the internal combustion engine in a first mode and in a second mode, the first mode controlling the air-fuel ratio to a predetermined air-fuel ratio, the second mode controlling the air-fuel ratio to an air-fuel ratio that is leaner than the predetermined air-fuel ratio of the first mode, ii) output the discharge waveform control signal in the second mode, and iii) prohibit execution of the second mode when it has been determined that the waveform control communication line is abnormal.

3. The ignition control system according to claim 1, wherein the electronic control unit is configured to variably control a delay time of an input timing of the discharge waveform control signal to the ignition apparatus relative to an input timing of the ignition signal to the ignition apparatus, the discharge control unit is configured to control a discharge current value depending on the delay time such that the discharge current value in a case where the delay time is relatively long is greater than the discharge current value in a case where the delay time is relatively short, and the electronic control unit is configured to decrease an upper limit of output of the internal combustion engine when it has been determined that the waveform control communication line is abnormal.

4. An ignition control system for an internal combustion engine, the ignition control system comprising:

an ignition apparatus including an ignition coil having a primary coil and a secondary coil, a spark plug connected with the secondary coil, the spark plug communicating with a combustion chamber of the internal combustion engine, a discharge control circuit configured to continue discharge of the spark plug after a start of the discharge of the spark plug, and a discharge control unit configured to control a discharge current of the spark plug by operating the discharge control circuit, after the start of the discharge of the spark plug;

an electronic control unit configured to output an ignition signal and a discharge waveform control signal to the ignition apparatus, the ignition signal commanding energization of the primary coil, and the discharge waveform control signal commanding control of the discharge current by the discharge control circuit;

an ignition communication line configured to transmit the ignition signal from the electronic control unit to the ignition apparatus; and a waveform control communication line configured to transmit the discharge waveform control signal from the electronic control unit to the ignition apparatus, wherein the electronic control unit is configured to determine whether the waveform control communication line is abnormal, based on at least one of i) a condition that an electric potential of the waveform control communication line in a period during which the discharge waveform control signal is not output to the waveform control communication line corresponds to an electric potential when the discharge waveform control signal is output and ii) a condition that electric current flows through the primary coil or the secondary coil in a period other than a period during which the discharge waveform control signal is output to the waveform control communication line and a period during which the ignition signal is output to the ignition communication line, the electronic control unit is configured to variably control a delay time of an input timing of the discharge waveform control signal to the ignition apparatus relative to an input timing of the ignition signal to the ignition apparatus, the discharge control unit is configured to control a discharge current value depending on the delay time such that the discharge current value in a case where the delay time is relatively long is greater than the discharge current value in a case where the delay time is relatively short, and the electronic control unit is configured to decrease an upper limit of output of the internal combustion engine when it has been determined that the waveform control communication line is abnormal.

* * * * *